United States Patent [19]

Hopmans

[11] Patent Number: 4,737,755

[45] Date of Patent: Apr. 12, 1988

[54] INDUCTANCE DEVICE COMPRISING A FERROMAGNETIC CORE WITH AN AIRGAP

[75] Inventor: Jan H. M. Hopmans, Tilburg, Netherlands

[73] Assignee: U.S. Philips Corporation, New York, N.Y.

[21] Appl. No.: 879,699

[22] Filed: Jun. 27, 1986

[30] Foreign Application Priority Data

Jul. 11, 1985 [NL] Netherlands ..... 8501994

[51] Int. Cl.[4] ..... H01F 17/06; H01F 27/30

[52] U.S. Cl. ..... 336/178; 336/198

[58] Field of Search ..... 336/165, 178, 198, 208

[56] References Cited

U.S. PATENT DOCUMENTS

| | | | |
|---|---|---|---|
| 2,699,532 | 1/1955 | Bussing | 336/178 X |
| 4,409,523 | 11/1983 | Yasumura | 336/178 X |
| 4,587,506 | 5/1986 | Hoeksma | 336/178 |

FOREIGN PATENT DOCUMENTS

| | | | |
|---|---|---|---|
| 969130 | 5/1958 | Fed. Rep. of Germany | 336/165 |
| 662711 | 12/1951 | United Kingdom | 336/178 |
| 105310 | 8/1980 | Japan | 336/198 |
| 315762 | 10/1956 | Switzerland | 336/165 |

*Primary Examiner*—Thomas J. Kozma

*Attorney, Agent, or Firm*—David R. Treacy; Bernard Franzblau

[57] ABSTRACT

An inductor device having a ferromagnetic core with an airgap. The ferromagnetic core contains two U-shaped sections (1, 3) with their limbs (5, 7) directed towards each other. One pair of limbs directed towards each other is surrounded by a coil former (9) made of an electrically insulating material, on the inner surface of which is located a projecting element (13) at right angles to the longitudinal direction of the limbs. The projecting element extends between the ends of the limbs that are surrounded by the coil former and determines or defines the width of an airgap (15) between those ends. The ends of the other set of limbs pointing towards each other (5, 7) are placed directly one against the other.

6 Claims, 1 Drawing Sheet

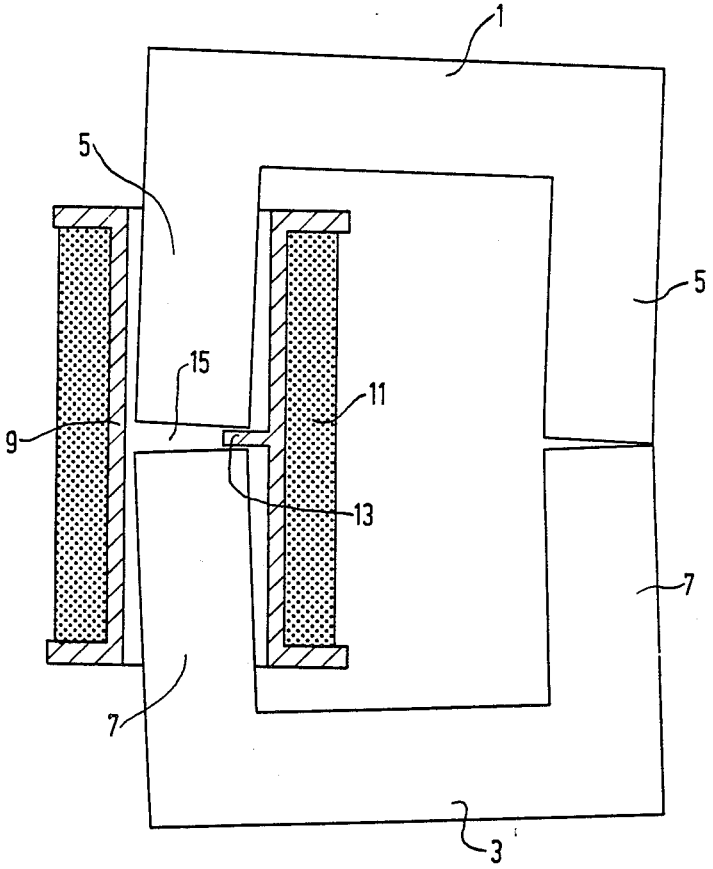
1
5
5
15
11
9
13
7
7
3

INDUCTANCE DEVICE COMPRISING A FERROMAGNETIC CORE WITH AN AIRGAP

BACKGROUND OF THE INVENTION

The invention relates to an inductive device comprising a ferromagnetic core which contains two U-shaped parts whose limbs are directed towards each other, which parts form a magnetic circuit interrupted by an airgap. At least one pair of limbs point towards each other and are surrounded by a coil former made from an electrically insulating material.

An example of such a device is known from GS-A-1,246,458 (PHN 2884). A description is given therein of a transformer whose ferromagnetic core between the ends of each pair of limbs directed towards each other contains an airgap which is filled with a mixture of hard granules and an adhesive. The diameter of the granules, for example glass granules, determines the width of the airgap. The adhesive with the glass granules has to be applied by hand because the presence of the granules would soon make an automatic feed device defective as a result of the clogging or leakage of valves. Furthermore, granules possessing the required accurately defined size may be difficult to obtain and are expensive.

SUMMARY OF THE INVENTION

It is an object of the invention to provide a device, of the kind mentioned in the preamble, in which the width of the airgap is defined in a simple manner and without the use of a mixture of granules and adhesive and in which the two core sections are electrically interconnected so that they do not have to be separately grounded. To this end the device in accordance with the invention is characterized in that the ends of one pair of limbs pointing towards each other are placed directly one against the other and that on the inner surface of the coil former that is placed around the other set of limbs pointing towards each other there is situated a projecting element at right angles to the longitudinal direction of the limbs. This projecting element extends between the ends of the limbs surrounded by the coil former which are directed towards each other and determines the width of the airgap situated between these ends.

It should be noted from FR-A-902,108 a potcore is known, the whole circumference of which is provided with an airgap whose width is determined by a flange on the coil former. This construction is not suitable for cores built up from U-shaped sections and the core sections are electrically insulated from each other by the coil former.

BRIEF DESCRIPTION OF THE DRAWING

The invention will now be elucidated with reference to the drawing which shows by way of example a longitudinal section of an embodiment of an inductor device

DETAILED DESCRIPTION OF THE PREFERRED EMBODIMENT

The device shown contains a ferromagnetic core which consists of two U-shaped parts 1, 3, for example, of ferrite, which are positioned in such a way that their limbs 5 and 7, respectively, are directed towards each other. A pair of limbs 5, 7 so directed (the pair on the left in the FIGURE) is surrounded by a coil former 9 made from electrically insulating material, for example a plastic, which former is provided with a winding 11.

The winding 11 may for example consist of a single coil, in particular when the device is a choke coil. The winding 11 may also contain more than one coil to form a transformer. The coils may for example be wound from copper wire or from aluminium foil.

Situated on the inner surface of the coil former 9 is a projecting element 13 which is directed approximately at right angles to the longitudinal direction of the limbs 5, 7 and extends between the inward-pointing ends of the two limbs that are surrounded by the coil former. This projecting element 13 therefore determines the distance between the two limbs and hence the width of an airgap 15 which constitutes an interruption of the magnetic circuit formed by the two core sections 1, 3. The two limbs 5, 7 not surrounded by the coil former are placed directly one against the other. This has the advantage that the two core sections are electrically interconnected so that they do not have to be separately grounded. If necessary, however, it is also possible to fit around the two right limbs 5, 7 a coil former which may carry one or more of the transformer windings.

The two sections 1, 3 of the core can be fixed together by means of an adhesive applied in the airgap 15 and to the ends of the two right limbs 5, 7, which adhesive may consist of, for example, an epoxy-resin without the addition of granules. It is also possible to fix together the two core sections 1, 3 by means of a clamp or screw-connection, the airgap 15 then being filled if required, with a hardening glue or similar material. The coil former 9 is kept in its place by the projecting element 13 clamped in the airgap 15, so that no separate means of attachment are needed for this purpose.

What is claimed is:

1. An inductive device comprising: a ferromagnetic core having two U-shaped sections with their limbs directed towards each other such that the sections form a magnetic circuit interrupted by an airgap, at least one pair of limbs pointing towards each other being surrounded by a coil former made of an electrically insulating material, characterized in that ends of another pair of limbs pointing towards each other directly contact one another and that an inner surface of the coil former includes a projecting element that extends approximately at right angles to the longitudinal direction of the one pair of limbs, and wherein the projecting element extends only part way between the ends of the limbs surrounded by the coil former and is dimensioned so as to determine the width of the airgap situated between said ends of the one pair of limbs.

2. An inductor device comprising: a ferromagnetic core including first and second U-shaped sections having their limbs directed towards each other such that said first and second sections form a magnetic circuit interrupted by an airgap formed between facing ends of one pair of limbs, an electrically insulating coil former having an inner surface surrounding a part of said one pair of limbs and the airgap, the other pair of limbs having facing ends in direct contact with one another, and wherein the inner surface of the coil former includes a projecting insulating element extending approximately at a right angle to the longitudinal direction of the one pair of limbs and protruding only part way into said airgap between said facing ends of the one pair of limbs and dimensioned so as to define the width of said airgap, and at least one winding mounted on said coil former.

3. An inductor device as claimed in claim 2 wherein the inner surface of the coil former defines a channel having an opening with uniform lateral dimensions along its longitudinal direction except for said projecting element.

4. An inductor device as claimed in claim 2 wherein said projecting element extends into the airgap from only one side of said one pair of limbs.

5. An inductor device as claimed in claim 2 wherein said projecting element is formed as one body with said coil former.

6. An inductor device as claimed in claim 2 wherein only a part of the facing ends of said one pair of limbs are in contact with said projecting element.

* * * * *